US012152866B2

(12) United States Patent
Akhmad et al.

(10) Patent No.: US 12,152,866 B2
(45) Date of Patent: Nov. 26, 2024

(54) ENERGY HARVESTING ASSEMBLIES

(71) Applicant: BAE SYSTEMS plc, London (GB)

(72) Inventors: Mohammed-Asif Akhmad, Chelmsford (GB); Richard Binns, Chelmsford (GB); Daniel Phillip Crane, Chelmsford (GB)

(73) Assignee: BAE SYSTEMS PLC, London (GB)

( * ) Notice: Subject to any disclaimer, the term of this patent is extended or adjusted under 35 U.S.C. 154(b) by 40 days.

(21) Appl. No.: 17/644,388

(22) Filed: Dec. 15, 2021

(65) Prior Publication Data

US 2022/0187048 A1 Jun. 16, 2022

(30) Foreign Application Priority Data

Dec. 16, 2020 (EP) ..... 20275182
Dec. 16, 2020 (GB) ..... 2019888

(51) Int. Cl.
*F42B 10/26* (2006.01)
*F42B 12/38* (2006.01)

(52) U.S. Cl.
CPC ..... *F42B 10/26* (2013.01); *F42B 12/38* (2013.01)

(58) Field of Classification Search
CPC ..... F42B 10/26; F42B 12/38; F42B 12/382; H02K 16/005; H02K 23/60; H02K 5/24
See application file for complete search history.

(56) References Cited

U.S. PATENT DOCUMENTS 1,819,106 A * 8/1931 McBride ..... F42B 10/26 102/365
6,186,290 B1 * 2/2001 Carlson ..... F16D 57/002 188/164
9,035,475 B1 5/2015 Cunningham
11,573,069 B1 * 2/2023 Parrow ..... F42B 10/26
2004/0099173 A1 5/2004 Rectirm et al.
2006/0065775 A1 * 3/2006 Smith ..... F42B 10/26 244/3.23
2006/0103252 A1 * 5/2006 Yokota ..... H02K 21/222 310/74
2008/0237391 A1 * 10/2008 Mock ..... F42B 10/64 244/3.1

(Continued)

FOREIGN PATENT DOCUMENTS

EP 0675335 A2 10/1995
WO 2008108869 A2 9/2008
WO 2018091873 A1 5/2018

OTHER PUBLICATIONS

Extended European Search Report received for EP Application No. 20275182.2, dated Jun. 9, 2021. 5 pages.

(Continued)

*Primary Examiner* — Christopher D Hutchens
(74) *Attorney, Agent, or Firm* — Finch & Maloney PLLC

(57) ABSTRACT

According to some examples, a non-incendiary projectile comprises a housing defining an internal cavity, and an energy harvesting structure comprising a first part and a second part, the first part provided on an inner surface of the housing, the second part provided in the internal cavity, the second part further comprising a rotation damping system configured to regulate a rate of rotation of the second part in a rotational direction about a flight axis defined by the housing.

13 Claims, 2 Drawing Sheets

(56) References Cited

U.S. PATENT DOCUMENTS

| | | | | |
|---|---|---|---|---|
| 2014/0217743 | A1* | 8/2014 | Sugita | F03D 9/25 290/55 |
| 2020/0292287 | A1 | 9/2020 | Thoren et al. | |

OTHER PUBLICATIONS

GB Combined Search and Examination Report under Sections 17 and 18(3) received for GB Application No. 2019888.3, dated Jun. 10, 2021. 5 pages.

* cited by examiner

ENERGY HARVESTING ASSEMBLIES

RELATED APPLICATIONS

The application claims priority to Great Britain patent application no. 2019888.3 filed on 16 Dec. 2020 and European patent application no. 20275182.2 filed on 16 Dec. 2020. Each of these applications is herein incorporated by reference in its entirety.

TECHNICAL FIELD

Aspects relate, in general, to an energy harvesting assembly, and more specifically, although not exclusively to an energy harvesting assembly for a non-incendiary projectile.

BACKGROUND

A projectile, such as a bullet, can be propelled from the barrel of a gun using propellant in the form of, e.g., a chemical explosive. The projectile can reach speeds in excess of 1000 mph. In order to stabilise a projectile, it is common for, e.g., the barrel of a gun from which the projectile is ejected to be rifled—that is, to be provided with spiral grooves on an inner surface of the barrel. The rifling causes a projectile travelling through the barrel to rotate around its longitudinal (leading to trailing) axis. This rotation imparts gyroscopic stability to the projectile.

Some projectiles, typically termed tracers or tracer rounds can be used to provide a visible trajectory to enable the flight path of the projectile to be determined. The visible trajectory enables a user to visualise the path of the projectile, and to make ballistic alterations so as to correct the flight path and thus ultimately the end impact point of the projectile. Such projectiles can comprise a pyrotechnic composition that is ignited when the round is fired. The composition is such that the visible trajectory can be seen by the naked eye in daylight as well as night-time. The pyrotechnic composition, being incendiary in nature, can be unintentionally ignited. Furthermore, such compositions can be unreliable in terms of, e.g., the nature of light produced and the duration over which the composition burns due to variations that may occur during manufacture or storage. Some non-incendiary tracer projectiles can use non-incendiary means to generate a visible path. However, in order to power such means, which are typically electronic in nature, there is a need to provide a power source within the projectile. Since the power sources will generally comprise a chemical agent of some form, the aforementioned issues remain relevant.

SUMMARY

According to a first aspect, there is provided a non-incendiary projectile comprising a housing defining an internal cavity, the non-incendiary projectile comprising an energy harvesting structure comprising a first part and a second part, the first part provided on an inner surface of the housing, the second part provided in the internal cavity, the second part further comprising a rotation damping system configured to regulate a rate of rotation of the second part in a rotational direction about a flight axis defined by the housing. The projectile may be a tracer projectile, which is non-incendiary inasmuch as it does utilise a pyrotechnic agent to generate a trace following propulsion.

In an implementation of the first aspect, one of the first and second parts can comprise an arrangement of magnetic elements configured to generate a magnetic field within the internal cavity. The other one of the first and second parts can comprise an armature. That is, one part can comprise multiple magnetic components, with the other part comprising multiple electrically conductive windings configured to experience changes in magnetic flux due to regulation of rotation of the second part relative to the first part, which provokes a difference in the rates of rotation of the first and second parts relative to one another. The change in magnetic flux experienced induces an electromotive force.

The rotation damping system can comprise a bearing structure. That is, bearings may be provided to enable the second part to move freely within the housing. However, due to fictional forces acting as result of the bearings, the second part will necessarily rotate at a reduced rate compared with the housing. In an example, the bearing structure can comprise (or further comprise) a shaft mount. The second part can be mounted on the shaft, and rotate about the shaft.

In an implementation of the first aspect, the rotation damping system can comprise (or further comprise) a viscous fluid provided within the internal cavity. For example, oil may be provided within the cavity to impede the rate of rotation of the second part.

The rotation damping system can comprise a mass connected to the second part. For example, an eccentric mass counterweight can be mounted to the second part. This can impede the rotation of the second part relative to the first part.

Upon rotation of the non-incendiary projectile, the first part rotates relative to the second part. In an example, a rate of rotation of the first part is greater than a rate of rotation of the second part. The first part and the second part are configured to rotate in the same direction relative to one another. The non-incendiary projectile can be configured to rotate in the rotational direction upon exposure to an axial force generated using an explosive propellant.

According to a second aspect, there is provided a method for generating energy for a projectile, the method comprising providing an energy harvesting structure comprising a first part and a second part, the first part provided on an inner surface of the housing, the second part provided in the internal cavity, the second part further comprising a rotation damping system configured to regulate a rate of rotation of the second part in a rotational direction about a flight axis defined by the housing, and imparting a rotational component of motion to the projectile, whereby to rotate the first part relative to the second part.

The rotational component can be caused by propelling the projectile through a structure, such as a barrel of a gun for example, which is rifled (i.e., comprises spiral grooves that impart a spin to the projectile as it passes over them). Thus, the projectile can be configured to rotate in the rotational direction upon exposure to an axial force generated using an explosive propellant as it is fired from a gun or other such apparatus.

In an example, the method can further comprise regulating the rate of rotation of the second part in the rotational direction about the flight axis defined by the housing using a bearing structure. The rate of rotation of the second part in the rotational direction about the flight axis defined by the housing may also be regulated using a viscous fluid provided within the internal cavity.

BRIEF DESCRIPTION OF THE DRAWINGS

Embodiments will now be described, by way of example only, with reference to the accompanying drawings, in which.

DESCRIPTION

Figure 1:
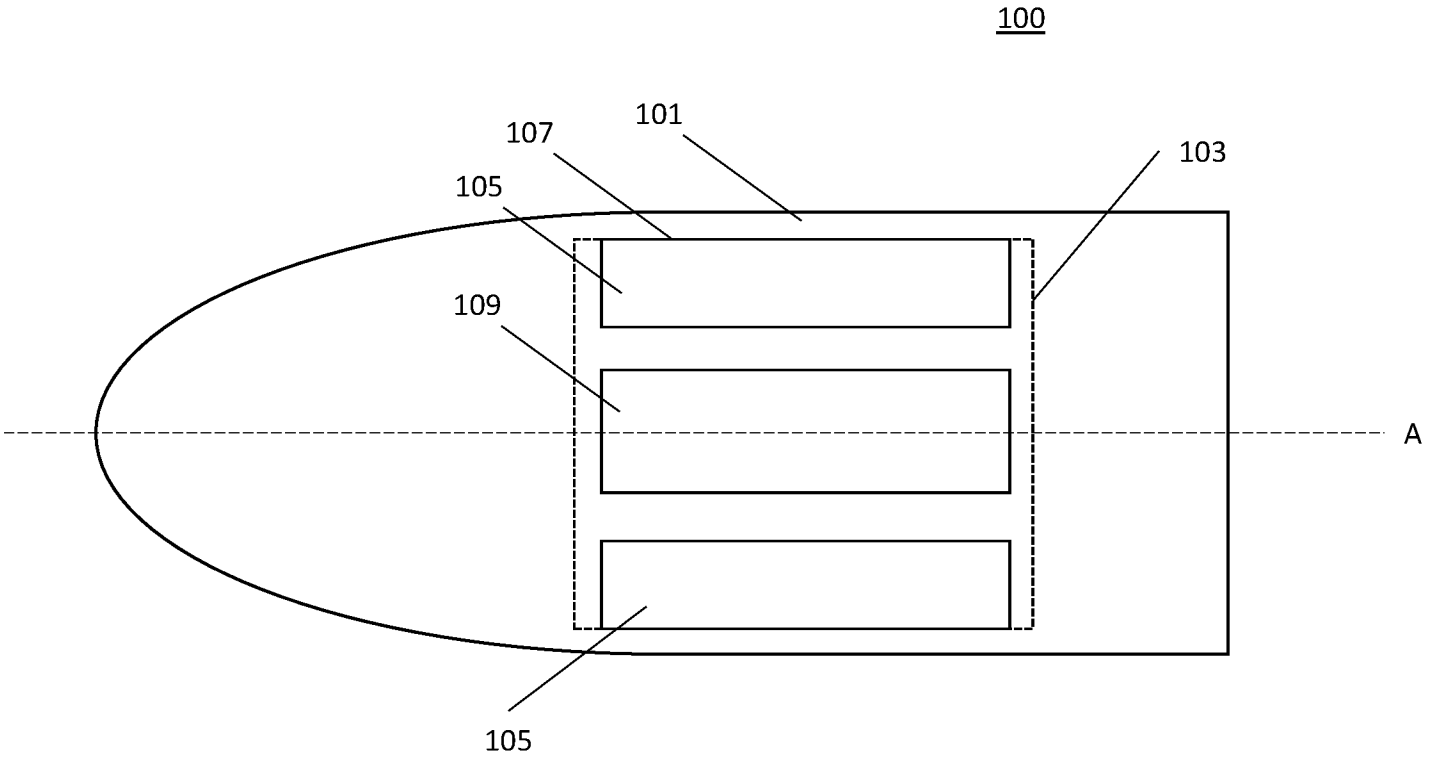
FIG. 1 is a schematic representation of a projectile according to an example.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

The use of pyrotechnic compositions in, e.g., incendiary tracers means that the location of the shooter can easily be determined by simple visual inspection of the starting point of the visible path that has been caused by ignition of the pyrotechnic agent in question, particularly since the light that is emitted is visible over a large number of viewing angles due to scattering of light in the smoke trail resulting from combustion of the pyrotechnic composition. This can be detrimental to a user if there are hostile observers in the vicinity. Nevertheless, the pyrotechnic compositions used are incapable of being modified or tuned to overcome this drawback. Furthermore, since the pyrotechnic composition is gradually exhausted as the tracer is in flight, the trajectory will alter in a manner that is different to that of non-tracer projectiles. This is in addition to the issue noted above with respect to storage and manufacture.

Non-incendiary tracers—that is, tracers that do not use pyrotechnic compositions to generate a visible path of the trajectory of the tracer—can be utilised in order to overcome some of the issues noted above. For example, a rearwardly directed electrically powered light source that is configured to emit light as the tracer is in flight can be used. However, in order to power such a light source, potentially volatile chemical-based power sources may typically be used, such as batteries or other power sources using an electrochemical activation mechanism in which, e.g., an electrochemical cell can be initiated by rupturing a container comprising an electrolyte. Initiation of the electrochemical cell is typically induced by the rapid acceleration associated with firing the projectile, which causes the container to break. Of course, the use of such power sources, whilst removing some of the issues surrounding the use of incendiary tracers, introduces other issues that stem from the nature of the electrochemical substances in use, including volatility and degradation.

According to an example, there is provided an energy harvesting assembly. The energy harvesting assembly can be used to generate power for use by one or more electrically dependent systems or devices of a projectile, such as a non-incendiary projectile or tracer. For example, the energy harvesting assembly can be used to generate power for a light source that is provided to generate a detectable trail for a projectile over at least a portion of its trajectory. The energy harvesting assembly can be used to generate power that may be used for other electrically dependent components of a projectile.

In an example, a projectile, such as a non-incendiary projectile, can comprise a housing defining an internal cavity. An energy harvesting structure for the projectile can comprise a first part and a second part. The first part can be provided on an inner surface of the housing of the projectile, and the second part can be provided in the internal cavity of the projectile. The first part and second part can be configured to rotate relative to one another. In an example, the second part can further comprise a rotation damping system configured to regulate a rate of rotation of the second part in a rotational direction about a flight axis defined by the housing. That is, the rotation damping system is configured to regulate a rate of rotation of the second part in a rotational direction around the longitudinal (leading to trailing) axis of the projectile. The action of the rotation damping system is configured to enable a difference in the rates of rotation of the first and second parts. With such a difference, an electric current can be induced, which may be used to power a component of the projectile.

According to an example, one of the first and second parts comprises an arrangement of magnetic elements configured to generate a magnetic field within the internal cavity. The other one of the first and second parts can comprise a set of windings. The set of windings can comprise electrically conductive wire and may be referred to as an armature. Thus, one of the first and second parts generates a magnetic field, whilst the other has a set of windings. As the first and second parts move relative to one another, such as when there is difference in the rates of rotation of the first and second parts caused by the rotation damping system for example, an electrical current is generated as a result of the changing magnetic field inducing an electric current.

Thus, as the projectile is ejected from an apparatus, such as a gun, that is configured to cause it to spin by way of, e.g., rifling, the first part of the energy harvesting structure rotates at a first rate of rotation since it is provided on an inner surface of the housing of the projectile, which itself is spinning at the first rate of rotation as a result of ejection from the apparatus. Due to the action of the rotation damping system, the second part will rotate at a second rate of rotation, which is less than the first rate of rotation, since it is rotationally impeded and is unable to rotate as fast as the first part, which is not so impeded. The difference in the rates of rotation of the first and second parts corresponds to a rotation of the first part relative to the second part, thereby provoking a changing magnetic field to be experienced by the second part, thus inducing an electric current.

FIG. 1 is a schematic representation of a projectile according to an example. Projectile 100 comprises a housing 101. The housing 101, which may be the jacket of the projectile for example, defines an internal cavity 103. The internal cavity 103 may be larger or smaller than that depicted in FIG. 1. In an example, an energy harvesting structure is provided for the projectile 100. The energy harvesting system comprises a first part 105 provided on an inner surface 107 of the housing. The energy harvesting system comprises a second part 109 provided in the internal cavity 103. The flight axis defined by the housing (i.e., the longitudinal (leading to trailing) axis) of the projectile 100 is depicted by dotted line A.

Figure 2:
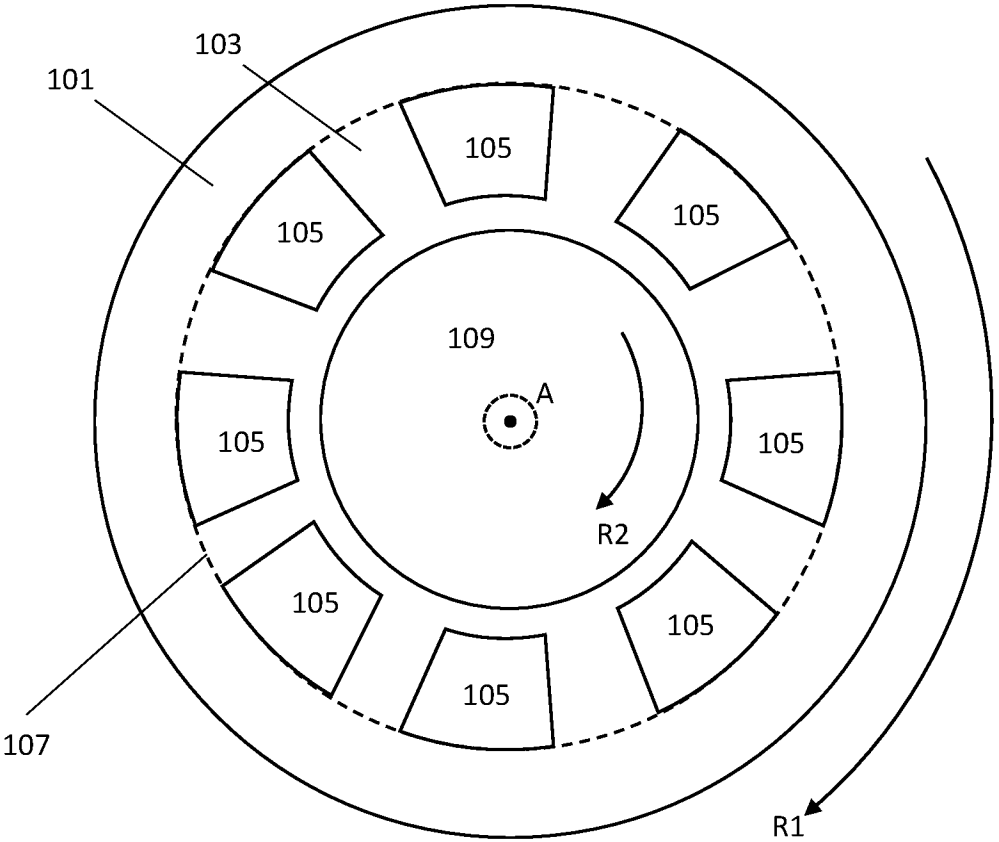
FIG. 2 is a schematic representation of a projectile according to an example.

FIG. 2 is a schematic representation of a projectile according to an example. The projectile of FIG. 2 is depicted in cross-section viewed along axis A, i.e., looking through the longitudinal axis of the projectile from tip to tail (or vice versa). In the example of FIG. 2, the first part 105 comprises multiple components provided on the inner surface 107 of the housing 101 of the projectile 100. The multiple components may be magnets for example, such as permanent magnets. The second part 109 can be provided centrally within the first part 105. As projectile 100 spins at a rate of rotation R1, parts 105 rotate at R1 since they are provided on the housing of the projectile, e.g., as integral parts, or adhered/fixed to the inner surface 107 of the housing 101. Part 109 rotates at a rate of rotation R2, which is different to R1. In an example R2<R1. The second part 109 comprises a rotation damping system configured to regulate the rate of rotation of the second part in a rotational direction about the flight axis A defined by the housing 101. In an example, the rotation damping system comprises a bearing structure. For example, bearings can be provided at either end of the second part 109 relative to axis A. Alternatively (or in addition), a shaft mount for the second part 109 can be provided along axis A. The second part 109 can be rotatably mounted to the shaft though, e.g., a channel running through the centre of the second part 109. Bearings may be provided between the shaft and the second part 109. Friction between the bearings and the second part will cause the rate of rotation of the second part, R2, to necessarily be less than R1, since the first parts 105 are unimpeded. In another example, the rotation damping system can comprise a viscous fluid provided within the internal cavity. For example, an oil may be provided within the cavity in order to slow the rate of rotation of the second part 109. In another example, the rotation damping system can comprise a mass connected to the second part 109. For example, the mass can be an eccentric mass counterweight mounted to the second part.

The invention claimed is:

1. A non-incendiary projectile comprising:

a housing defining an internal cavity; and an energy harvesting structure comprising a first part and a second part, the first part provided on an inner surface of the housing, the second part provided in the internal cavity, the second part comprising a rotation damping system configured to regulate a rate of rotation of the second part in a rotational direction about a flight axis defined by the housing;

wherein the rotation damping system comprises a viscous fluid within the internal cavity, and wherein the non-incendiary projectile is a tracer round, and includes a rearwardly directed light source that receives power from the energy harvesting structure.

2. The non-incendiary projectile of claim 1, wherein one of the first and second parts comprises an arrangement of magnetic elements configured to generate a magnetic field within the internal cavity.

3. The non-incendiary projectile of claim 2, wherein the other one of the first and second parts comprises an armature.

4. The non-incendiary projectile of claim 1, wherein, upon rotation of the non-incendiary projectile, the first part rotates relative to the second part.

5. The non-incendiary projectile of claim 4, wherein a rate of rotation of the first part is greater than a rate of rotation of the second part.

6. The non-incendiary projectile of claim 1, wherein the first part and the second part are configured to rotate in the same direction about the flight axis.

7. The non-incendiary projectile of claim 1, wherein the non-incendiary projectile is configured to rotate in the rotational direction upon exposure to an axial force generated using an explosive propellant.

8. The non-incendiary projectile of claim 1, wherein the viscous fluid is an oil.

9. A non-incendiary projectile comprising:

a housing defining an internal cavity and a central axis;

an energy harvesting structure comprising a first part and a second part, the first part provided on an inner surface of the housing, the second part provided in the internal cavity and configured to rotate about the central axis with respect to the housing, the first part including an arrangement of magnetic elements fixed to the inner surface of the housing and configured to generate a magnetic field within the internal cavity, the second part including an armature and a rotation damping system, the rotation damping system configured to regulate a rate of rotation of the second part in a rotational direction about a flight axis defined by the housing; and an oil in the internal cavity, the oil having a viscosity that impedes the rate of rotation of the second part;

wherein, upon rotation of the non-incendiary projectile, the first part rotates relative to the second part; and wherein a rate of rotation of the first part is greater than the rate of rotation of the second part.

10. The non-incendiary projectile of claim 9, wherein the first part and the second part are configured to rotate in the rotational direction upon exposure of the housing to barrel rifling.

11. The non-incendiary projectile of claim 9, including a light source that is configured to receive power from the energy harvesting structure.

12. A method for generating energy for a non-incendiary projectile, the method comprising:

providing an energy harvesting structure comprising a first part and a second part, the first part provided on an inner surface of a housing, the second part provided in an internal cavity defined by the housing of the projectile, the second part further comprising a rotation damping system configured to regulate a rate of rotation of the second part in a rotational direction about a flight axis defined by the housing, wherein the rotation damping system comprises a viscous fluid within the internal cavity, and wherein the non-incendiary projectile is a tracer round, and includes a rearwardly directed light source that receives power from the energy harvesting structure; and imparting a rotational component of motion to the non-incendiary projectile, whereby to rotate the first part relative to the second part; and regulating the rate of rotation of the second part in the rotational direction about the flight axis by way of the viscous fluid.

13. The method of claim 12, wherein the viscous fluid is an oil.

* * * * *